US008170455B2

(12) United States Patent
Miyadera

(10) Patent No.: US 8,170,455 B2
(45) Date of Patent: May 1, 2012

(54) DEVICE AND METHOD FOR CORRECTING MISREGISTRATION, AND IMAGE FORMING APPARATUS

(75) Inventor: Tatsuya Miyadera, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 1178 days.

(21) Appl. No.: 11/852,808

(22) Filed: Sep. 10, 2007

(65) Prior Publication Data

US 2008/0069602 A1 Mar. 20, 2008

(30) Foreign Application Priority Data

Sep. 19, 2006 (JP) ..... 2006-253147

(51) Int. Cl.
*G03G 15/01* (2006.01)

(52) U.S. Cl. ..... 399/301; 347/116

(58) Field of Classification Search ..... 399/301, 399/49, 72; 347/116
See application file for complete search history.

(56) References Cited

U.S. PATENT DOCUMENTS

| | | | | |
|---|---|---|---|---|
| 2002/0136570 | A1* | 9/2002 | Yamanaka et al. | 399/301 |
| 2003/0214568 | A1 | 11/2003 | Nishikawa et al. | |
| 2006/0165442 | A1* | 7/2006 | Kobayashi et al. | 399/301 |
| 2006/0250495 | A1* | 11/2006 | Iwamoto | |

FOREIGN PATENT DOCUMENTS

| | | |
|---|---|---|
| EP | 1 496 403 A1 | 1/2005 |
| JP | 6-193476 | 7/1994 |
| JP | 6-253151 | 9/1994 |
| JP | 2642351 | 5/1997 |
| JP | 2004-12549 | 1/2004 |
| JP | 2005-1129 | 1/2005 |
| JP | 2005-289035 | 10/2005 |

OTHER PUBLICATIONS

U.S. Appl. No. 12/210,491, filed Sep. 15, 2008, Miyadera.
Office Action issued Aug. 5, 2011, in Japanese Patent Application No. 2006-253147.

* cited by examiner

*Primary Examiner* — David Porta
*Assistant Examiner* — Milton Gonzalez
(74) *Attorney, Agent, or Firm* — Oblon, Spivak, McClelland, Maier & Neustadt, L.L.P.

(57) ABSTRACT

A misregistration correcting device includes an image forming unit, a sensor, a reading unit, and a determining unit. The image forming unit form a set of misregistration correcting patterns that includes a reference pattern. The sensors start detecting the set when a predetermined time has elapsed after start of image formation for the first set. The reading unit reads positional information of the set upon detection of the set. The determining unit determines timing to start detecting subsequent sets of misregistration correcting patterns based on positional information of the reference pattern in the first set.

7 Claims, 8 Drawing Sheets

DEVICE AND METHOD FOR CORRECTING MISREGISTRATION, AND IMAGE FORMING APPARATUS

CROSS-REFERENCE TO RELATED APPLICATIONS

The present application claims priority to and incorporates by reference the entire contents of Japanese priority document, 2006-253147 filed in Japan on Sep. 19, 2006.

BACKGROUND OF THE INVENTION

1. Field of the Invention

The present invention relates to a technology for correcting misregistration.

2. Description of the Related Art

In a conventional electrophotographic color image forming apparatus, a photosensitive drum as an image carrier is electrified by an electrifying unit, and a latent image is formed on the electrified photosensitive drum by a laser beam delivered corresponding to image information, and the latent image is developed by a developing unit, and an image is formed by transferring a developed toner image to sheet material and the like.

Tandem system color image forming apparatuses are widely used that include a plurality of image stations to perform such series of image forming processes to form a color image. Such color image is formed by superimposing images in different colors of C (cyan), M (magenta), Y (yellow), and BK (black) on individual image carriers, and transferred onto a recording sheet on an endless transfer belt at the transfer positions of each image carrier.

In the tandem system color image forming apparatus, if the positions of images for respective colors are deviated from ideal positions when the images formed on image carriers are transferred onto a recording sheet on a transfer belt, a low quality image with color shift is formed on the recording sheet.

Japanese Patent No. 2642351, for example, discloses a conventional technology, in which misregistration correcting patterns are formed on a transfer belt, and read by a charge coupled device (CCD) sensor, etc. to detect misregistration of color images photosensitive drums and thereby to electrically correct an image signal to be recorded. The shift of laser-beam path length or the deviation of the beam path is corrected by moving a reflecting mirror placed in the beam path. The images of misregistration correcting patterns are linear patterns of Y, M, C, and BK toners, and in general in this method, as assigning any one color pattern as a reference position, the time when each of the rest of color patterns is detected by a sensor is observed, and the amount of misregistration for each color is obtained by calculating the differences between the positions of each color patterns, that are obtained from the observed time and a conveyor speed, and theoretical values.

Japanese Patent Application Laid-Open Publication No. 6-193476 discloses another conventional technology that eliminates the fluctuations in the amount of misregistration, that may occur due to the rotational fluctuations of a photosensitive drum. That is, a plurality of sets of misregistration correcting patterns are formed in the sub-scanning direction (longitudinal direction) of a conveyor belt for respective colors, and the amounts of misregistration of the individual sets are averaged.

A processing procedure using the misregistration correcting pattern includes a process to correlate detected patterns with detected time, and a process where positional information is converted from information on the detection time and conveyor-belt speed, and the latter corresponds to the reading of positional information. However, when a plurality of sets of misregistration correcting patterns are formed in the sub-scanning direction, and the detection and the reading of positional information are performed for each pattern set at a predetermined time (time when the position slightly ahead of the tip of each pattern set is expected to be detected) elapsed from the start of exposure, the positional information of the patterns may not be read for the entire sets because the predetermined time may not be inserted to every interval among pattern sets due to dimensional tolerances in the layout of units for the formation and detection of the misregistration correcting patterns, e.g., the expansion or shrinkage of a transfer belt, that may be caused by environmental changes or by their design.

SUMMARY OF THE INVENTION

It is an object of the present invention to at least partially solve the problems in the conventional technology.

According to an aspect of the present invention, a misregistration correcting device includes a plurality of image forming units (6Y, 6M, 6C, and 6BK) for different colors that form a plurality of sets of misregistration correcting patterns that includes linear patterns each corresponding to one of the colors arranged in a sub-scanning direction, the sets of misregistration correcting patterns including a first set, a second set, and a third set; a pattern detecting unit (17, 18, 19) that starts detecting the first set when a predetermined time has elapsed after start of image formation for the first set; a reading unit (30) that reads positional information of each set of misregistration correcting patterns in response to detection of the set; and a first determining unit (30) that determines timing to start detecting the second and subsequent sets of misregistration correcting patterns based on positional information of a reference pattern in the first set.

According to another aspect of the present invention, an image forming apparatus including a misregistration correcting device that includes a plurality of image forming units (6Y, 6M, 6C, and 6BK) for different colors that form a plurality of sets of misregistration correcting patterns that includes linear patterns each corresponding to one of the colors arranged in a sub-scanning direction, the sets of misregistration correcting patterns including a first set, a second set, and a third set; a pattern detecting unit (17, 18, 19) that starts detecting the first set when a predetermined time has elapsed after start of image formation for the first set; a reading unit (30) that reads positional information of each set of misregistration correcting patterns in response to detection of the set; and a determining unit (30) that determines timing to start detecting the second and subsequent sets of misregistration correcting patterns based on positional information of a reference pattern in the first set.

According to still another aspect of the present invention, a misregistration correcting method includes forming a plurality of sets of misregistration correcting patterns that includes linear patterns each corresponding to one color arranged in a sub-scanning direction, the sets of misregistration correcting patterns including a first set, a second set, and a third set; detecting the first set upon elapse of a predetermined time after start of image formation for the first set; reading positional information of each set of misregistration correcting patterns in response to detection of the set; and determining timing to start detecting the second and subsequent sets of misregistration correcting patterns based on positional information of a reference pattern in the first set.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below referring to the accompanying drawings.

Figure 1:
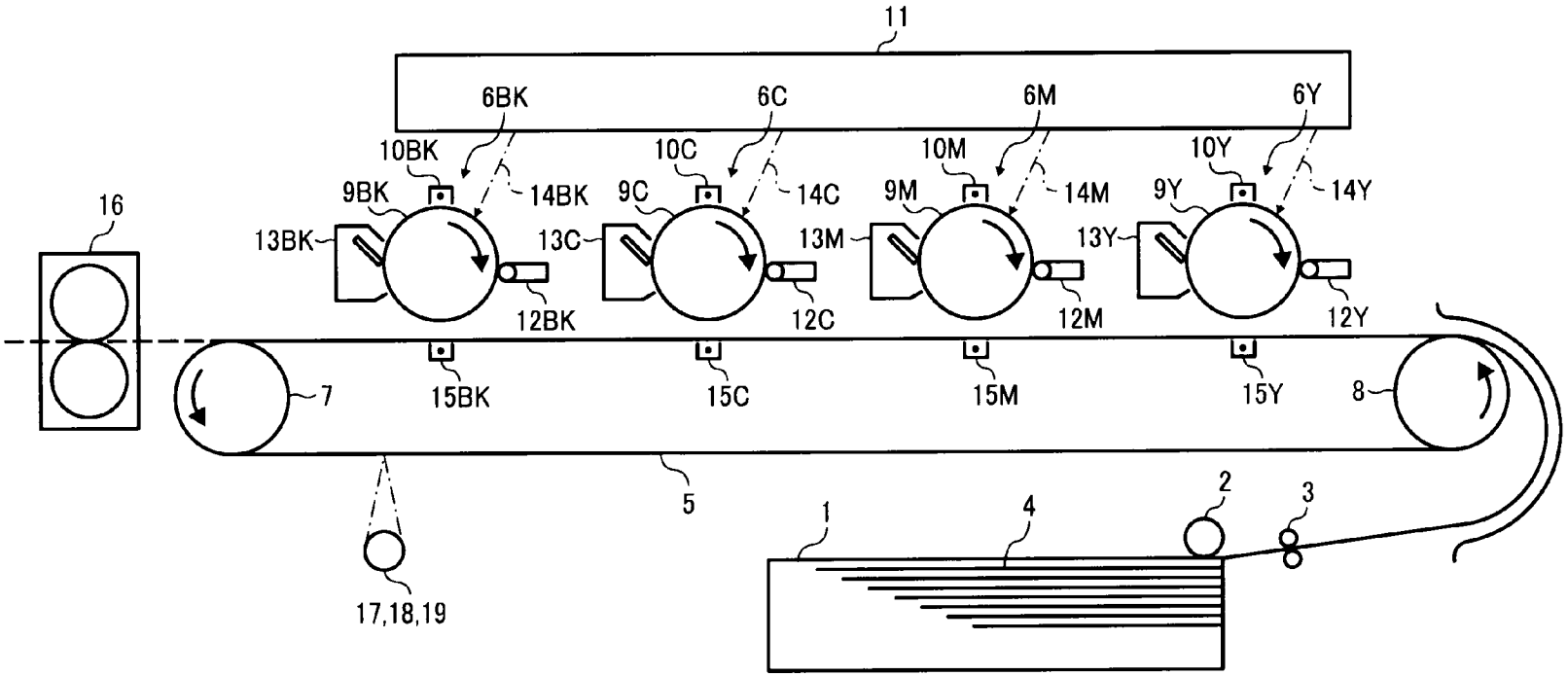
FIG. 1 is a schematic diagram of image processing units and a transfer belt of an image forming apparatus according to a first embodiment of the present invention.

FIG. 1 is a schematic diagram of image processing units and a transfer belt of a tandem color image forming apparatus according to a first embodiment in the present invention.

The tandem color image forming apparatus includes a plurality of image forming units (electrophotographic processing units) 6Y, 6M, 6C, and 6BK for different colors arranged along a conveyor belt 5 (endless conveying unit). Specifically, the image forming units 6Y, 6M, 6C, and 6BK are arranged in this order from the upstream of the conveying direction along the conveyor belt 5 that conveys a sheet (recording medium) 4 that is fed from a sheet-feed tray 1 by a feeding roller 2 and separating rollers 3.

The image forming units 6Y, 6M, 6C, and 6BK are of basically similar in configuration and operate in the same manner except that they form toner images of different colors: yellow, magenta, cyan, and black, respectively. Therefore, but one of them, for example, the image forming unit 6Y, is described in detail below.

The conveyor belt 5 is an endless belt that extends around a driving roller 7, that is rotationally driven, and a follower roller 8. The driving roller 7 is rotationally driven by a driving motor (not shown), and the driving motor, the driving roller 7, and the follower roller 8 function as a driving unit to move the conveyor belt 5.

In image formation, the sheets 4 stacked in the sheet-feed tray 1 are fed from the top of the stack and conveyed by the conveyor belt 5 to the first image forming unit 6Y while electrostatically adhering to the conveyor belt 5, so that a yellow toner image is transferred onto the sheets 4.

The image forming unit 6Y includes a photosensitive drum 9Y, an electrifier 10Y arranged around the photosensitive drum 9Y, an exposing unit 11, a developer 12, a cleaner (not shown), and a neutralizer 13Y. The exposing unit 11 delivers laser beams 14Y, 14M, 14C, and 14BK as exposing beams corresponding to toner images formed by the image forming units 6Y, 6M, 6C, and 6BK, respectively.

In image formation, the outer circumference surface of the photosensitive drum 9Y is equally electrified by the electrifier 10Y in the dark, and is then exposed to the laser beam 14Y corresponding to a yellow image from the exposing unit 11. Thus, an electrostatic latent image is formed. The developer 12Y visualizes (develops) the electrostatic latent image by yellow toner to form a yellow toner image on the photosensitive drum 9Y.

The toner image is transferred onto the sheet 4 by a transfer unit 15Y at a position where the photosensitive drum 9Y and the sheet 4 on the conveyor belt 5 contact (transfer position). By the transfer, the yellow toner image is formed on the sheet 4. When the toner-image transfer has completed, residual toner remained on the outer circumference surface is removed by the cleaner, and the photosensitive drum 9Y is neutralized by the neutralizer 13Y and waits for the next image formation.

The sheet 4 onto which the yellow toner image is transferred at the image forming unit 6Y is conveyed to the next image forming unit 6M by the conveyor belt 5. At the image forming unit 6M, a magenta toner image is formed on a photosensitive drum 9M through in the same manner as in the image forming unit 6Y, and the toner image is transferred and superimposed on the yellow image formed on the sheet 4.

The sheet 4 is further conveyed to the image forming units 6C and 6BK, so that cyan and black toner images formed on photosensitive drums 9C and 9BK, respectively, are transferred onto the sheet 4 by superimposition. Thus a full color image is formed on the sheet 4. The sheet 4 having s full color image is ejected from the image forming apparatus after the image is fixed thereto by a fuser 16.

In the color image forming apparatus described above, color misregistration may occur because toner images may not overlap each other at desired positions due to possible errors in inter-axis distances among the photosensitive drums 9Y, 9M, 9C, and 9BK, in parallelism among the photosensitive drums 9Y, 9M, 9C, and 9BK, in the installation of a deflecting mirror (not shown) to deflect laser beam in the exposing unit 11, and in the formation timing of electrostatic latent images to the photosensitive drums 9Y, 9M, 9C, and 9BK. As the main components of color misregistration are known skews, misregistration in the sub-scanning direction, magnification error and misregistration in the main-scanning direction.

In the first embodiment, a plurality of sets of misregistration correcting patterns are formed on the conveyor belt 5 being arranged regularly in the sub-scanning direction (conveying direction), and the misregistration correcting patterns are read by sensors 17, 18, and 19 arranged, facing to the conveyor belt 5, in the downstream of the image forming unit 6BK, and according to its deviation from an ideal position, skews, misregistration in the sub-scanning direction, magnification error and misregistration in the main-scanning direction are obtained. Correction is performed based on the amount of the misregistration. Specifically, correction is performed by declining the deflecting mirror in the exposing unit 11 or the exposing unit 11 itself by an actuator for the skew, and by controlling timing to start drawing lines and the plane phase of the deflecting mirror for the misregistration in the sub-scanning direction. As for the magnification error in the main-scanning direction, correction is performed by, for example, changing the frequency of a printed image. As for the misregistration in the main-scanning direction, correction is performed by controlling timing to start to draw main-scanning lines.

Figure 2:
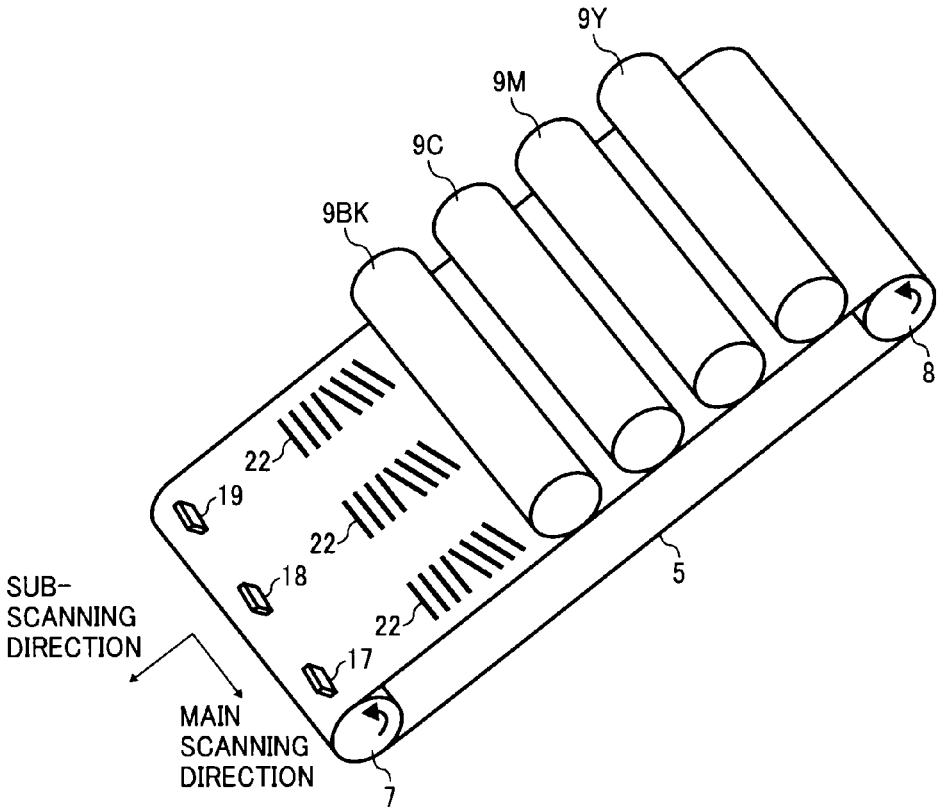
FIG. 2 is a perspective view of a conveyor belt, photosensitive drums, and sensors shown in FIG. 1.

FIG. 2 is a perspective view of the conveyor belt 5, photosensitive drums 9Y, 9M, 9C, and 9BK and the sensors 17, 18, and 19. As shown in FIG. 2, misregistration correcting patterns 22 are formed on the conveyor belt 5. The sensors 17, 18, and 19 are supported on a common circuit board (not shown) along the main-scanning direction orthogonal to the conveying direction of the sheet 4. Each one row of the misregistration correcting patterns 22 is formed on the starting edge, in the center, and on the ending edge in the main-scanning direction corresponding to the sensors 17, 18, and 19.

Figure 3:
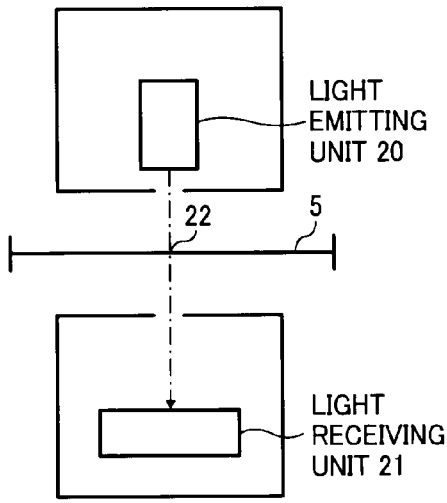
FIG. 3 is a schematic diagram of sensors shown in FIG. 1.

As shown in FIG. 3, each of the sensors 17, 18, and 19 has a light emitting unit 20 and a light receiving unit 21. Light emitted from the light emitting unit 20 and then reflected by the misregistration correcting patterns 22 is received and converted to an electric signal by the light receiving unit 21.

Figure 4:
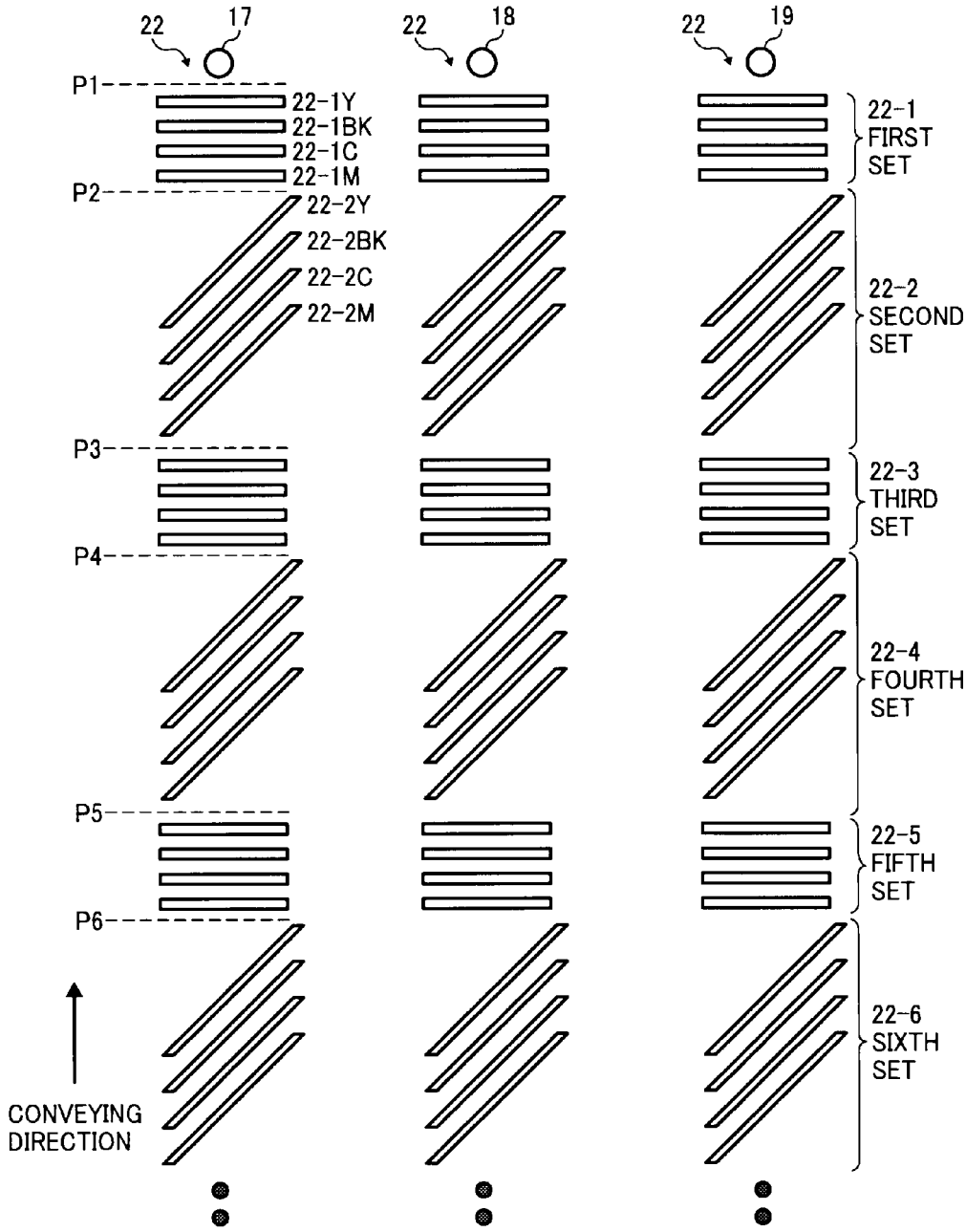
FIG. 4 is a schematic diagram of misregistration correcting patterns according to the first embodiment.

As shown in FIG. 4, the misregistration correcting patterns 22 in each row includes odd-numbered (first, third, fifth, . . . ) sets 22-1, 22-3, 22-5, . . . , in which lines parallel to the main-scanning direction are arranged in the sub-scanning direction in the order of Y, BK, M, and C, and even-numbered (second, fourth, sixth, . . . ) sets 22-2, 22-4, 22-6, . . . formed among the former sets, in which angled lines extending to the main-scanning direction are arranged in the sub-scanning direction in the order of Y, BK, C, and M. One odd-numbered and subsequent even-numbered set of misregistration correcting patterns are paired, and each amount of the skew, the misregistration in the sub-scanning direction, the magnification error in the main-scanning direction, and the misregistration in the main-scanning direction can be obtained based on the detection signal of the pair. Thus, to offset fluctuating errors generated by the rotational fluctuations of the photosensitive drums 9Y, 9M, 9C, 9BK, and of the conveyor belt 5, rows that contain a plurality of pairs of misregistration correcting patterns fitting for a single set of photosensitive drum are formed, for example, and the misregistration correcting pattern rows are read by the sensors 17, 18, and 19, and then, more precise correction can be performed by calculating the average of the readings in the sub-scanning direction. The amount of misregistration can be calculated by a known method described, for example, Japanese Patent No. 2642351, and Japanese Patent Application Laid-Open No. 2005-289035.

Figure 5:
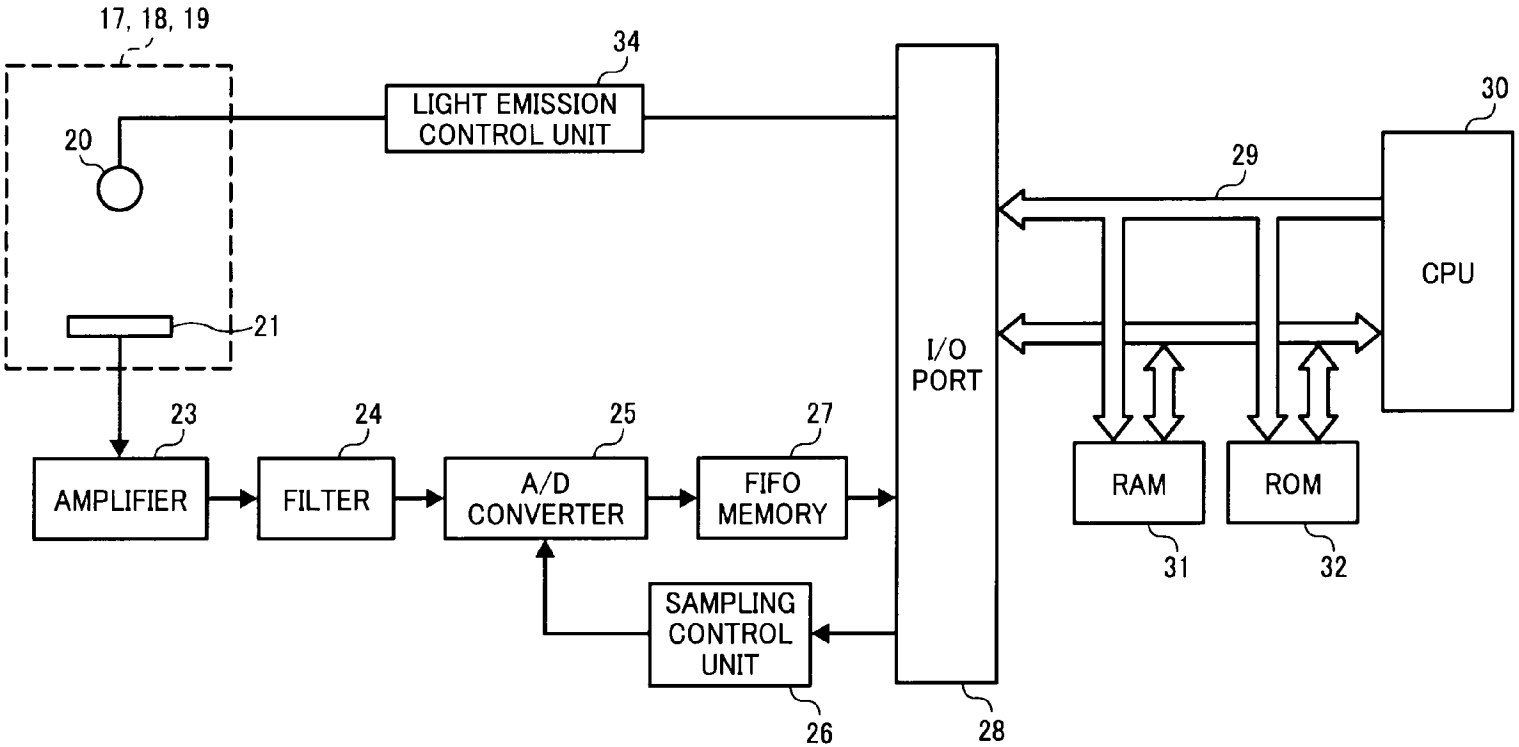
FIG. 5 is a block diagram of a misregistration detecting device that detects misregistration based on detection signals from the sensors corresponding to the misregistration correcting patterns shown in FIG. 4.

FIG. 5 is a block diagram of a misregistration detecting device that detects the amount of color misregistration based on detection signals from the sensors 17, 18, and 19 corresponding to the misregistration correcting patterns 22 shown in FIG. 4. The misregistration detecting device includes a central processing unit (CPU) 30, a random access memory (RAM) 31, and a read only memory (ROM) 32, which are interconnected via a data bus 29. The misregistration detecting device further includes an input/output (I/O) port 28, a light-emission control unit 34 that controls the amount of light emitted by the light emitting units 20 of the sensors 17, 18, and 19, and an amplifier 23 that receives a detection signal output from the light receiving units 21 of the sensors 17, 18, and 19, a filter 24, an analog-to-digital (A/D) converter 25, a sampling control unit 26, and a first-in first-out (FIFO) memory 27. The amplifier 23, the filter 24, the A/D converter 25, the sampling control unit 26, and the FIFO memory 27 are connected to the I/O port 28.

The detection signal of the misregistration correcting patterns that is output by the light receiving unit 21 is amplified by the amplifier 23, and only the signal of line detection component (edge component in the sub-scanning direction) is selected to go through by the filter 24, and is converted from analogue data to digital data by the A/D converter 25. The sampling timing of digital data at the A/D converter 25 is controlled by the sampling control unit 26, and sampled data is stored in the FIFO memory 27. The stored data is read out at a predetermined timing and is loaded into the CPU 30 and the RAM 31 through the data bus 29 via the I/O port 28, and the CPU 30 calculates positional information by a prepared arithmetic process and obtains the misregistration amount described above. The read-out timing may be at the end of the storage of a pair (two sets) of the misregistration correcting patterns 22, or at the end of the storage of a set of the misregistration correcting patterns 22, or simultaneous with the storages.

The ROM 32 stores therein, in addition to a computer program for calculating each of the misregistration amounts, computer programs for misregistration correction and image-formation control. The CPU 30 monitors detection signals from the light receiving unit 21 at an appropriate timing, and controls the amount of light emitted by the light-emission control unit 34 to keep the level of light reception signals from the light receiving unit 21 constant to certainly detect the degradations of the conveyor belt 5 and the light emitting unit 20. Thus the CPU 30 and the ROM 32 function as a control unit to control the operation of the entire image forming apparatus.

The operation of the misregistration detecting device is explained below. The misregistration detecting device is capable of controlling a plurality of types of misregistration correction depending upon its setting. These settings are hereinafter referred to as first to third misregistration correcting processes and are explained referring to FIGS. 6 to 8. In the following explanations, it is assumed that the misregistration correcting patterns 22 shown in FIG. 4 are formed on the conveyor belt 5.

Figure 6:
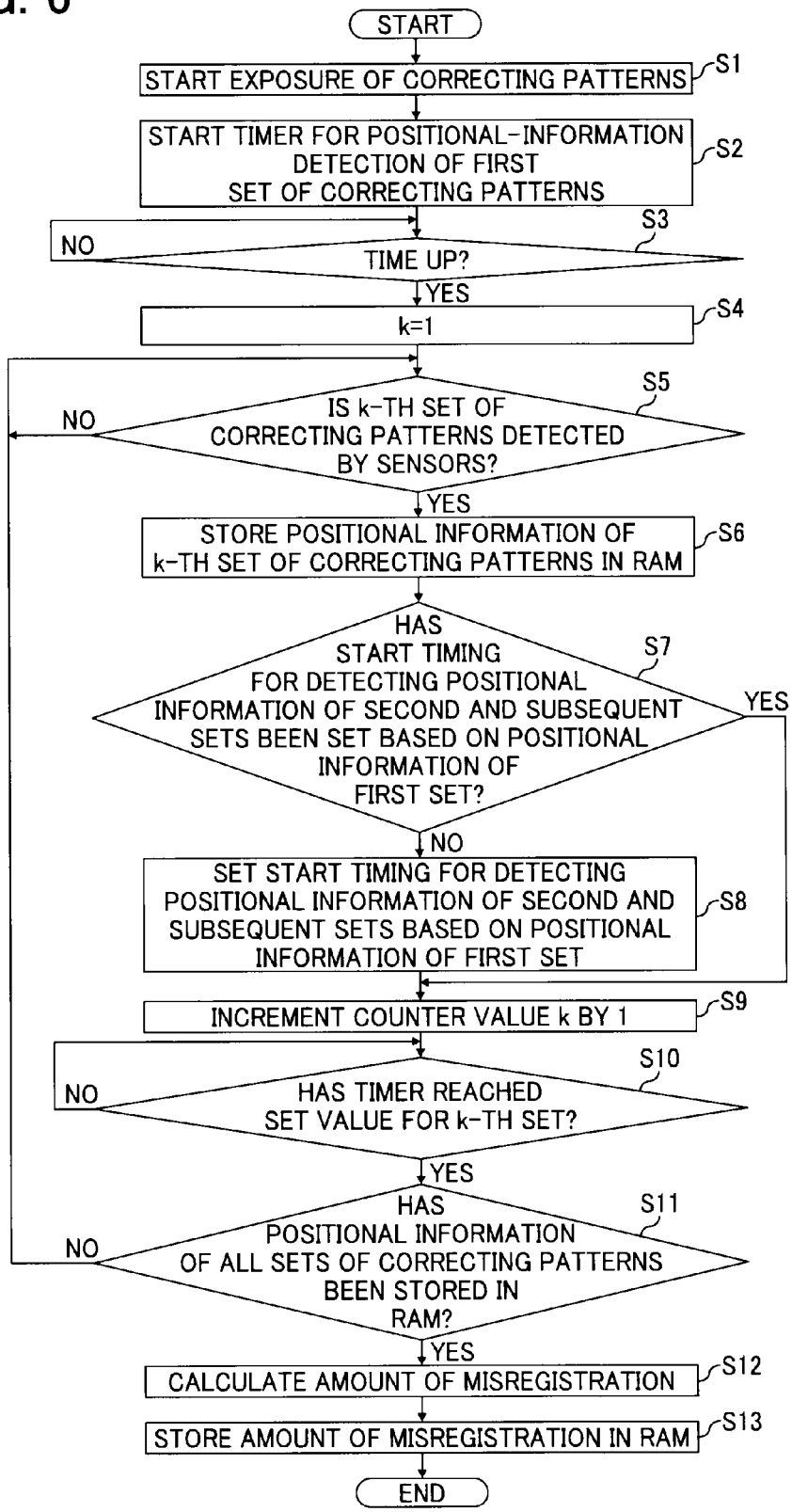
FIGS. 6 to 8 are flowcharts of first to third misregistration correcting processes according to the first embodiment.

FIG. 6 is a flowchart of the first misregistration correcting process. To form a Y pattern 22-1Y in the first set 22-1 of the misregistration correcting patterns 22 on the conveyor belt 5, exposure is started by delivering a laser beam 14 on the photosensitive drum 9Y at the image forming unit 6Y (step S1), and a Y toner image is transferred onto the conveyor belt 5 by the transfer unit 15Y. A timer for the detection of the first set of misregistration correcting patterns 22 is started simultaneously with the start of the exposure of the photosensitive drum 9Y (step S2). Although the timer may ideally be set so that time is up when the position slightly ahead, in the sub-scanning direction, of the Y pattern 22-1Y that is located in the head of the first set of misregistration correcting patterns 22 (P1 in FIG. 4) is expected to reach the position where the sensors 17, 18, and 19 are arranged, it should practically be set so that the time is up slightly earlier taking the tolerance of the conveyor belt 5 into account. Thereafter, as shown in FIG. 4, a magenta pattern 22-1M, a cyan pattern 22-1C, a black pattern 22-1BK of the first set of misregistration correcting patterns 22-1, a yellow pattern 22-2Y, a magenta pattern 22-2M, a cyan pattern 22-2C, a black pattern 22-2BK of the second set of misregistration correcting patterns 22-2 are formed in sequence on the conveyor belt 5 according to the movement of the conveyor belt 5.

When the head pattern 22-1Y of the first set of misregistration correcting patterns 22-1 approaches close to the sensors 17, 18, and 19, the set time of the timer is up (YES at step S3). The counter value k of a counter for counting the number of sets of the misregistration correcting patterns 22 is set to "1" (step S4). The light emitting units 20 of the sensors 17, 18, and 19 are turned on, and simultaneously, the monitoring of output signals from the light receiving unit 21 is started. If the misregistration correcting patterns 22 is detected (YES at step S5), data is stored in the FIFO memory 27. The stored data is loaded into the CPU 30 and the RAM 31, and positional information is obtained and stored in the RAM 31 (step S6). Thus, in the first misregistration correcting process, the CPU 30 starts reading positional information simultaneously with that data on the detection of the misregistration correcting patterns 22 is stored in the FIFO memory 27.

Based on the positional information of the reference image-forming color patterns of the first set of misregistration correcting patterns 22-1, it is determined whether the start timing for detecting the second and subsequent sets of misregistration correcting patterns has been set (step S7). If not (NO at step S7), after setting the start timing (step S8), or if it has already been set (YES at step S7), the counter value k is incremented by 1 (step S9). Start timing for detecting the second and subsequent sets of misregistration correcting patterns should be set at the time when the position slightly ahead, in the sub-scanning direction, of Y patterns that are located in the head of individual sets of misregistration correcting patterns (P2, P3, P4, P5, P6, . . . in FIG. 4) are expected to reach the position where the sensors 17, 18, and 19 are arranged.

As the start timing for detecting the second and subsequent sets of misregistration correcting patterns have not yet been set, the counter value k is incremented to 2 after the settings are specified at step S8. The reference image-forming color patterns are the ones formed at the furthest position from the sensors 17, 18, and 19, i.e., Y patterns. This is because, between the image forming unit 6Y that forms Y patterns and the sensors 17, 18, and 19, the other image forming units 6M, 6C, and 6BK are arranged, all of their tolerances affect the positional information of the misregistration correcting patterns from their ideal positions, and thus the misregistration amount can be utilized for the rotation control of the photosensitive drums 9Y, 9M, 9C, and 9BK and for the conveyance control of the conveyor belt 5. However, the reference image-forming color patterns are not necessarily formed at the furthest position from the sensors 17, 18, and 19, and can be formed at other positions.

When the timer reaches to the set value of the start timing, which has been set at step S8, for detecting the k-th set (k=2 (second)) of misregistration correcting patterns (YES at step S10), it is determined whether the positional information of all the misregistration correcting patterns formed on the conveyor belt 5 have been stored in the RAM 31 (step S11). At this point, if not the positional information of all the misregistration correcting patterns has been stored yet, the process from step S5 is repeated. If the start timing for reading the second and subsequent sets of misregistration correcting patterns has already been set, the process proceeds from step S7 to step S9 by skipping step S8.

Thus, the process from steps S5 to S11 (excluding step S8) are repeated, and if it is determined at step S11 that the positional information of all the misregistration correcting patterns have been stored in the RAM 31, the amounts of misregistration that are obtained based on the positional information (step S12) are stored in the RAM 31 (step S13), and the misregistration correction ends.

In the first misregistration correcting process, since the start timing for detecting the second and subsequent sets of misregistration correcting patterns are determined based on the positional information of the first set of misregistration correcting patterns 22-1, only the tolerance of the first set of misregistration correcting patterns from an image forming position may affect the misregistration of the second and subsequent sets from an ideal position. Thus, the second and subsequent sets of misregistration correcting patterns can more reliably be detected and read compared with a conventional method to detect and to read positional information for one set at a time based on a uniquely predetermined time elapsed from the start of exposure.

Figure 7:
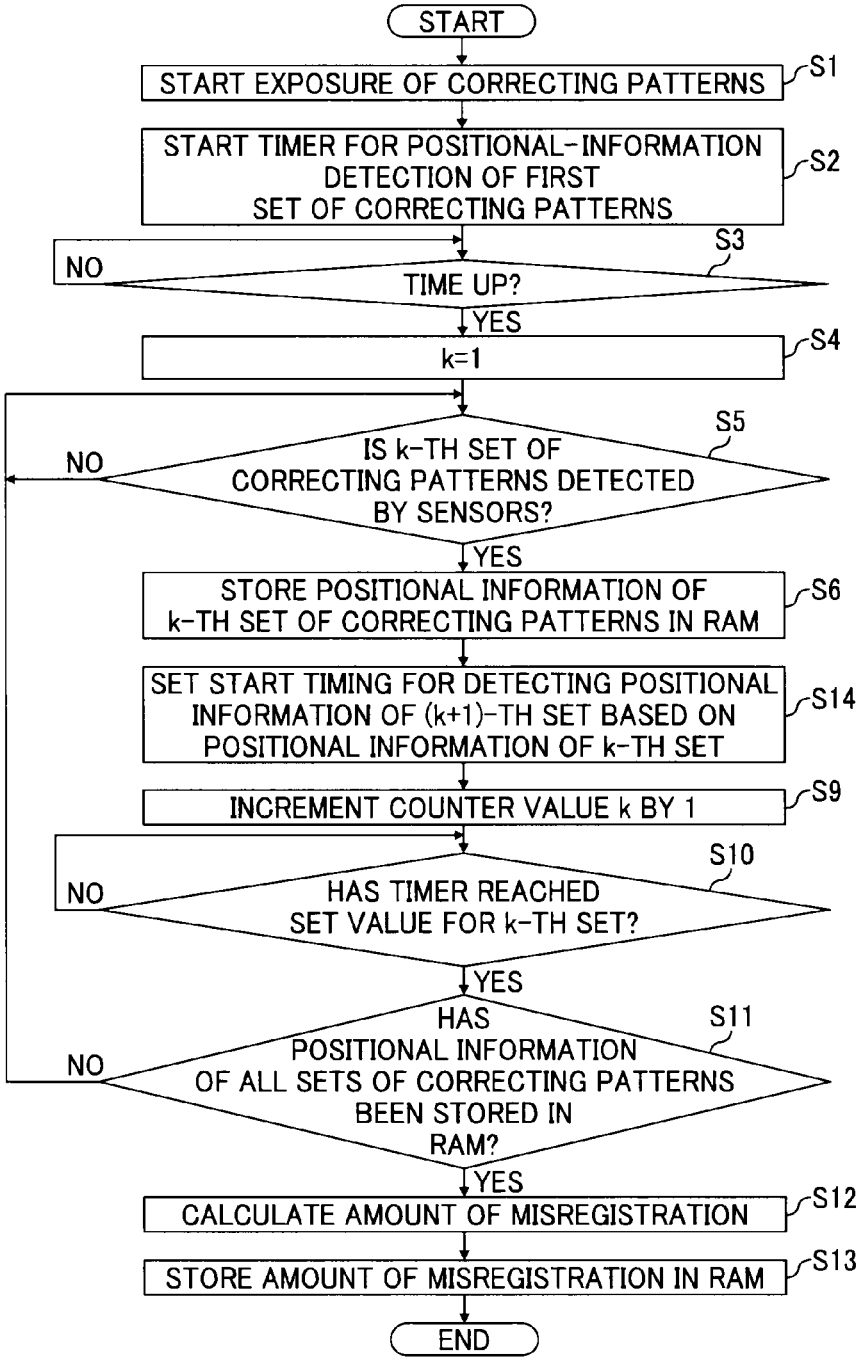

FIG. 7 is a flowchart of the second misregistration correcting process. Differently from the first misregistration correcting process shown in FIG. 6, in the second misregistration correcting process, setting of start timing for reading the positional information of a (k+1)-th set is repeated at step S14 based on the positional information of the reference image-forming color patterns of the k-th set with the increment of the k value.

Specifically, based on the positional information of the first set of misregistration correcting patterns 22-1, the start timing P2 for detecting the second set of misregistration correcting patterns 22-2 is determined, and based on its positional information, the start timing P3 for detecting the third set of misregistration correcting patterns 22-3 is determined, and thereafter, the steps are repeated until the final set is read. Thus, as for the second and subsequent sets, only the tolerance of an image forming position between neighboring sets affects the shift of the start timing of detection from an ideal position, the second and subsequent sets of misregistration correcting patterns can more reliably be detected and read even compared with the first misregistration correcting process.

Figure 8:
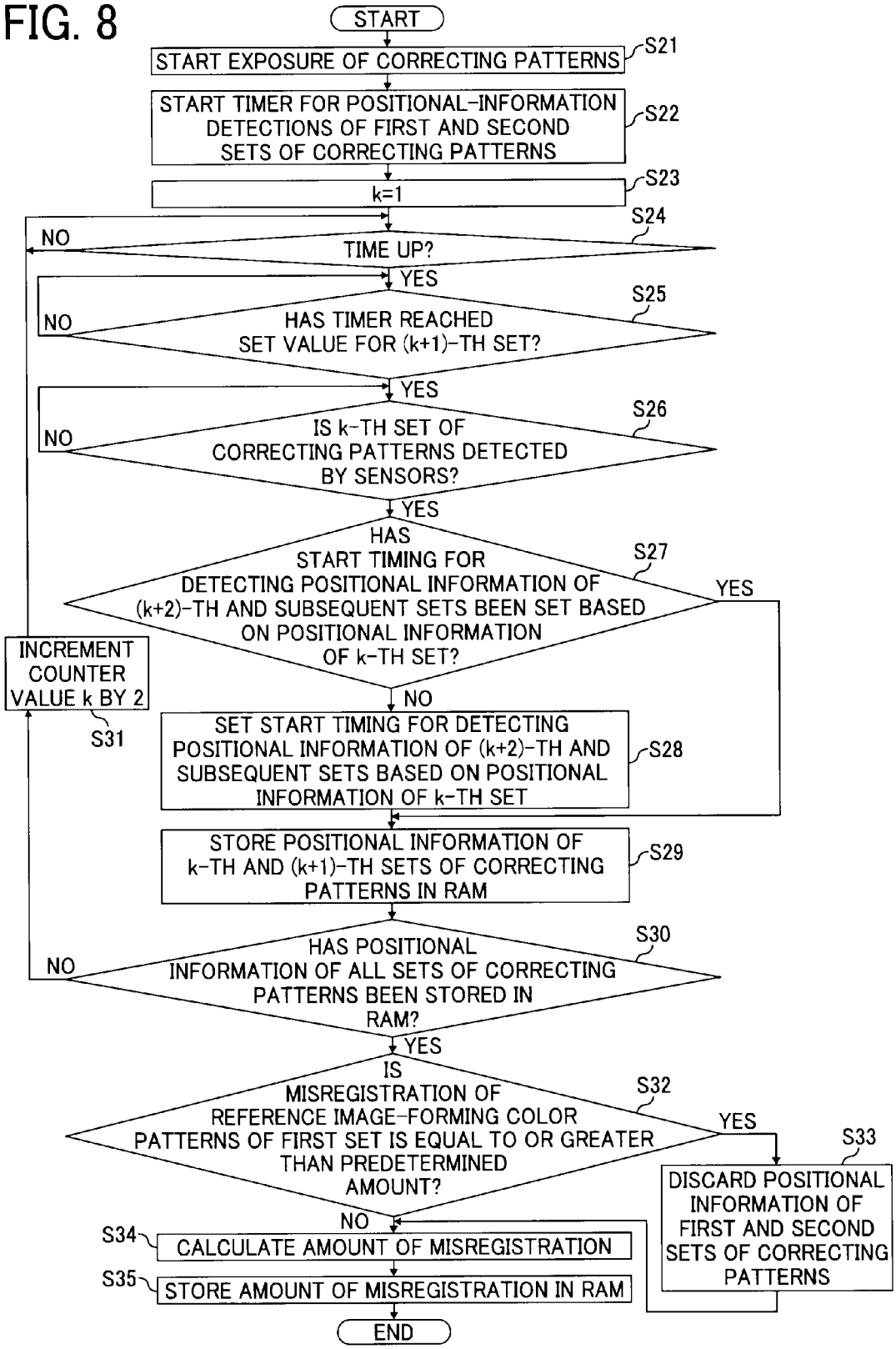

FIG. 8 is a flowchart of the third misregistration correcting process. The exposure of the photosensitive drum 9Y is started (step S21), and a timer for the detection of the first and second sets of misregistration correcting patterns 22 is started (step S22). Although the timer can be set so that time is up when the positions P1 and P2 in FIG. 4 are expected to reach the position where the sensors 17, 18, and 19 are arranged, it should practically be set so that the time is up slightly earlier taking the tolerance of the conveyor belt 5 into account. Subsequently, the counter value k of the counter for counting the number of sets of the misregistration correcting patterns 22 is set to "1" (step S23).

The set time of the timer is up (YES at step S24) when the head pattern 22-1Y of the first set of misregistration correcting patterns 22-1 approaches close to the sensors 17, 18, and 19. The light emitting units 20 of the sensors 17, 18, and 19 are then turned on, and the monitoring of output signals from the light receiving unit 21 is started. Simultaneously, if the misregistration correcting patterns 22 is detected, the data is stored in the FIFO memory 27. When the timer reaches to the set value of the start timing for detecting the (k+1)-th set (k+1=2 (second)) (YES at step S25), the second set of misregistration correcting patterns 22-2 is detected, and the data is stored in the FIFO memory 27.

If the k-th set of misregistration correcting patterns 22 has been detected (YES at step S26), based on the positional information of the reference image-forming color patterns of the k-th set, it is determined whether the start timing for detecting the (k+2)-th and subsequent sets of misregistration correcting patterns have been set (step S27), and is set if it is yet to be set (step S28). Because k=1, the start timing for detecting a third and subsequent sets of misregistration correcting patterns are set at step S28. As in the first misregistration correcting process shown in FIG. 6, the start timing for the detection should be set at the time when the position slightly ahead, in the sub-scanning direction, of Y patterns that are located in the head of individual sets of misregistration correcting patterns (P2, P3, P4, P5, P6, . . . in FIG. 4) are expected to reach the position where the sensors 17, 18, and 19 are arranged.

The data on the k-th and (k+1)-th sets that are previously stored in the FIFO memory 27 are loaded into the CPU 30 and the RAM 31, and positional information is obtained and is stored in the RAM 31 (step S29). In other words, the k-th and (k+1)-th sets of misregistration correcting patterns are detected, and the data is first stored in the FIFO memory 27, and at the end of memorization, the CPU 30 reads out and converts the data into positional information, and store the information in the RAM 31. Accordingly, load on the CPU 30 and the running time of the RAM 31 can be reduced. Thus, the difference in the third misregistration correcting process from the first and second misregistration correcting processes are in that an end timing for detecting the k-th set is introduced as the start timing for detecting the (k+1)-th set, and that the reading process that converts data into positional information is prompted by the completion of the detection of the k-th set.

Subsequently, it is determined whether the positional information of all misregistration correcting patterns formed on the conveyor belt 5 has been stored in the RAM 31 (step S30). If the positional information of all misregistration correcting patterns has not yet been stored, the counter value is incremented to 2 (step S31), and the process is repeated from step S24. If the start timing for detecting the third and subsequent sets of misregistration correcting patterns has already been set, the process proceeds from step S27 to step S29 by skipping step S28.

Thus, the process from steps S24 to S31 (excluding step S28) are repeated. If the positional information of all the misregistration correcting patterns has been stored in the RAM 31 (YES at step S30), it is determined whether the misregistration of the reference image-forming color patterns of the first set is equal to or greater than a predetermined amount (step S32). If it is equal to or greater than the predetermined amount, the positional information of the first and second sets of misregistration correcting patterns that is previously stored in the RAM 31 is discarded (step S33). Subsequently, the amount of each misregistration are obtained based on positional information in the RAM 31 (step S34), and is stored in the RAM 31 (step S35). Thus, the misregistration correction ends. As described above, failures in misregistration correction that may be caused by inaccurate positional information can be avoided by discarding data whose misregistration is equal to or greater than the predetermined amount.

Incidentally, in the second misregistration correcting process, the start timing for detecting the subsequent sets are determined based on the positional information of the reference image-forming color pattern of each of the second and subsequent sets. However, from the second and subsequent sets, the start timing for detecting each subsequent set can be determined based on the positional information of the reference image-forming color pattern of each group of sets.

In the third misregistration correcting process, the start timing for detecting the third and all subsequent sets are determined based on the positional information of the reference image-forming color pattern of the first set. However, from the third and subsequent sets, based on the positional information of each set of reference image-forming color patterns, the start timing can be determined for detecting the second subsequent sets of misregistration correcting patterns (=end timing of the detection of the subsequent set of misregistration correcting patterns=start timing for reading the subsequent set of misregistration correcting patterns).

In the third misregistration correcting process, from the third and subsequent sets, based on the positional information of the reference image-forming color patterns of each group of a plurality of sets, the start timing can be determined for detecting each second subsequent sets of misregistration correcting patterns.

Figure 9:
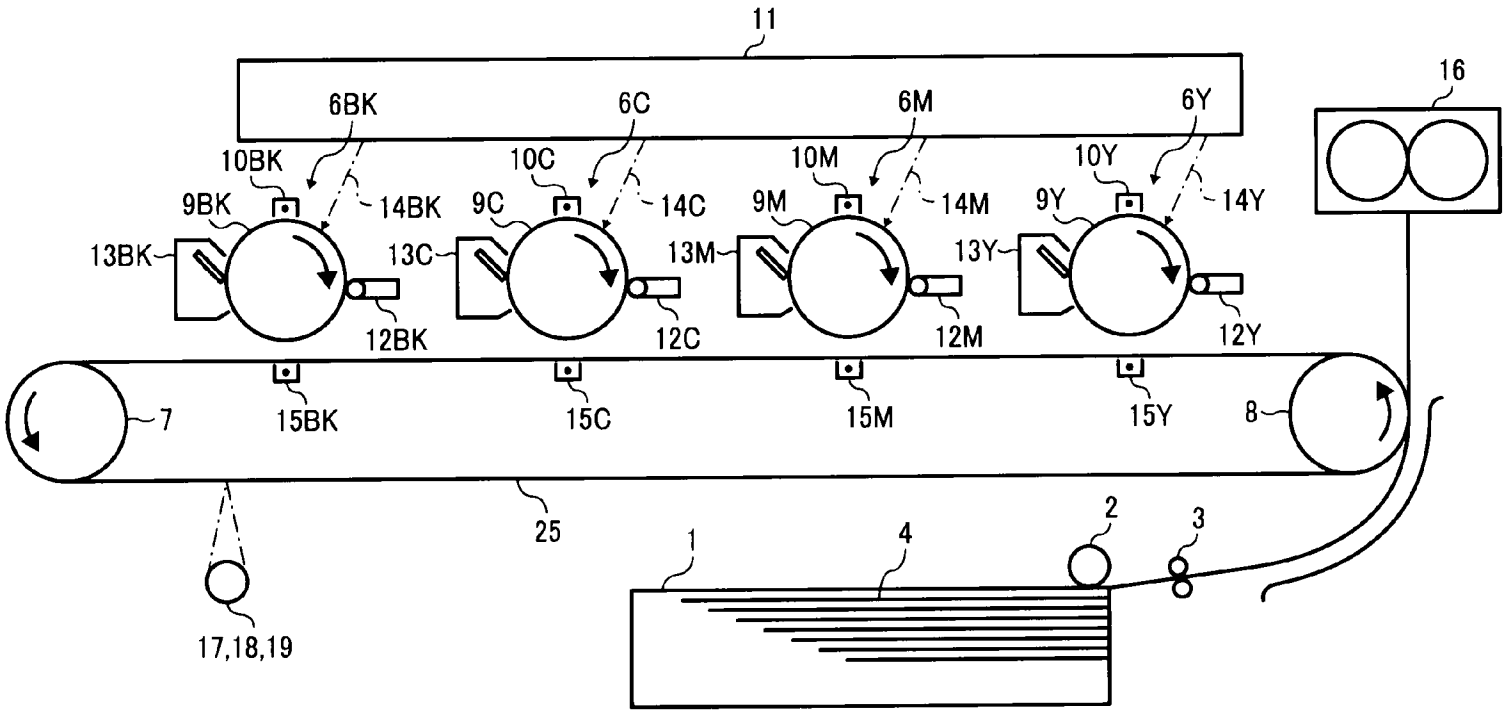
FIG. 9 is a schematic diagram of image processing units and a transfer belt of an image forming apparatus according to a second embodiment of the present invention.

FIG. 9 is a schematic diagram of image processing units and a transfer belt of a color image forming apparatus according to a second embodiment in the present invention. Like reference numerals refer to corresponding portions in the first and second embodiments.

In the color image forming apparatus according to the second embodiment, the toner images in different colors are transferred onto an intermediate transfer belt 25 by transfer units 15Y, 15M, 15C, and 15BK at a position (first transfer position) where the photosensitive drums 9Y, 9M, 9C, and 9BK and the intermediate transfer belt 25 contact. By the transfer, a full color image formed of superimposed toner images of different colors is formed on the intermediate transfer belt 25. In image formation, the sheets 4 stacked in the sheet-feed tray 1 are fed in turn from the top and conveyed to on top of the intermediate transfer belt 25, and the full color toner image is transferred at a position where the intermediate transfer belt 25 and the sheet 4 contact (second transfer position). The sheet 4 that holds the layered full color image is peeled off from the intermediate transfer belt 25 and ejected from the image forming apparatus after the fusion of the image by the fuser 16.

The intermediate transfer belt 25 is an endless belt extending around the driving roller 7 that is rotationally driven and the follower roller 8. Misregistration correcting patterns are formed on the intermediate transfer belt 25, and read by the sensors 17, 18, and 19. The composition of the misregistration correcting patterns and a configuration for their formation, detection, and for obtaining the amount of misregistration are the same as previously described in the first embodiment.

According to an embodiment of the present invention, the start timing for detecting second and subsequent sets of misregistration correcting patterns is determined based on the timing when the first set of misregistration correcting patterns has been read. Thus, only the tolerance of the first set of misregistration correcting patterns from an image forming position may affect the misregistration of the second and subsequent sets from an ideal position even if there are dimensional tolerances in the layout of units to perform the image formation and the detection of a plurality of sets of misregistration correcting patterns. Therefore, the second and subsequent sets of misregistration correcting patterns can be reliably read.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A misregistration correcting device comprising:

a plurality of image forming units for different colors that form a plurality of sets of misregistration correcting patterns that includes linear patterns each corresponding to one of the colors arranged in a sub-scanning direction, the sets of misregistration correcting patterns including a first set, a second set, and a third set;

a pattern detecting unit that starts detecting the first set when a predetermined time has elapsed after start of image formation for the first set;

a reading unit that reads positional information of each set of misregistration correcting patterns in response to completion of detection of each set, respectively; and a first determining unit that determines timing to start detecting the first set and the second set of misregistration correcting patterns based on a timer, and the first determining unit determines timing to start detecting each set of misregistration correcting patterns, from the third set, based on positional information of a reference pattern in a set second previous to a set being detected.

2. The misregistration correcting device according to claim 1, further comprising an information discarding unit that, when positional information of a reference pattern in the first set indicates misregistration equal to or greater than a predetermined amount, discards the positional information.

3. The misregistration correcting device according to claim 1, wherein each reference pattern corresponds to a color image formed by one of the image forming units located furthest from the pattern detecting unit.

4. An image forming apparatus comprising:

a misregistration correcting device that includes a plurality of image forming units for different colors that form a plurality of sets of misregistration correcting patterns that includes linear patterns each corresponding to one of the colors arranged in a sub-scanning direction, the sets of misregistration correcting patterns including a first set, a second set, and a third set;

a pattern detecting unit that starts detecting the first set when a predetermined time has elapsed after start of image formation for the first set;

a reading unit that reads positional information of each set of misregistration correcting patterns in response to completion of detection of each set, respectively; and a first determining unit that determines timing to start detecting the first set and the second set of misregistration correcting patterns based on a timer, and the first determining unit determines timing to start detecting each set of misregistration correcting patterns, from the third set, based on positional information of a reference pattern in a set second previous to a set being detected.

5. A misregistration correcting method comprising:

forming a plurality of sets of misregistration correcting patterns that includes linear patterns each corresponding to one color arranged in a sub-scanning direction, the sets of misregistration correcting patterns including a first set, a second set, and a third set;

detecting the first set upon elapse of a predetermined time after start of image formation for the first set;

reading positional information of each set of misregistration correcting patterns in response to completion of detection of each set, respectively;

determining timing to start detecting the first set and the second set of misregistration correcting patterns based on a timer; and determining timing to start detecting each set of misregistration correcting patterns, from the third set, based on positional information of a reference pattern in a set second previous to a set being detected.

6. The misregistration correcting method according to claim 5, further comprising, when positional information of a reference pattern in the first set indicates misregistration equal to or greater than a predetermined amount, discarding the positional information.

7. The misregistration correcting method according to claim 5, wherein the forming includes forming each reference pattern at a position furthest from where the detecting is performed.

* * * * *